United States Patent [19]

Kulpa

[11] Patent Number: 4,524,965

[45] Date of Patent: Jun. 25, 1985

[54] ENVELOPE STACKING MACHINE

[75] Inventor: Walter J. Kulpa, Trumbull, Conn.

[73] Assignee: Pitney Bowes Inc., Stamford, Conn.

[21] Appl. No.: 573,898

[22] Filed: Jan. 25, 1984

[51] Int. Cl.[3] ..... B65H 31/04

[52] U.S. Cl. ..... 271/214; 267/74; 271/160; 271/219; 414/107

[58] Field of Search ..... 271/304, 214, 215, 219, 271/149, 150, 160, 177–181; 414/103, 106, 107, 108; 267/73, 74, 174

[56] References Cited

U.S. PATENT DOCUMENTS

| | | | |
|---|---|---|---|
| 3,653,655 | 4/1972 | Striplin | 271/149 |
| 4,019,730 | 4/1977 | Staudinger et al. | 271/214 |
| 4,275,874 | 6/1981 | Di Blasio | 271/219 |
| 4,302,000 | 11/1981 | Frank | 271/150 |

*Primary Examiner*—Bruce H. Stoner, Jr.
*Assistant Examiner*—John A. Carroll
*Attorney, Agent, or Firm*—Martin D. Wittstein; William D. Soltow, Jr.; Albert W. Scribner

[57] ABSTRACT

An envelope stacking machine has a conveyor for feeding envelopes in a substantially vertical orientation along a predetermined path of travel. There is an elongate envelope stacking support for receiving envelopes directed to the support from a transfer device which pushes the envelopes against an envelope abutment member having a force converting apparatus attached thereto for maintaining a substantially uniform resisting force against the incoming stream of envelopes. The force converting apparatus contains resilient and flexible devices which operate in conjunction with a rotary displacement device to achieve the substantially uniform resisting force.

8 Claims, 4 Drawing Figures

ENVELOPE STACKING MACHINE

BACKGROUND OF THE INVENTION

Field of the Invention

The present invention relates to document stacking, and especially to envelope stacking in a mail sorting machine.

There are existing mail handling machines which are utilized for processing letter mail from the U.S. Post Office as it is received from the public. The letter mail received from the public is infinitely variable in respect to size and weight. For this reason alone, it becomes increasingly difficult to handle the letter mail, as it is generally placed into a stack for feeding from or subsequently being directed to an area where stacking of the letter mail takes place.

Typically, mixed letter mail is fed through a mail sorting machine which separates each mail piece so that there is a vertically oriented stream of mail progressing along a conveyor towards an optical code reading device which reads the address. Immediately thereafter, each mail piece is imprinted with a bar code representing the address zip code commensurate with a determined verification of the address zip code as checked by a cooperating computer which is connected to the mail sorter.

The OCR mail sorter processes letter mail at 128 inches per second. There are OCR mail sorters having as many as 60 sorting bins and as few as 12. Typically, each bin holds up to 425 average sized envelopes.

There is a need to have a substantial stacking capacity in each sorting bin since the sorter production rate is high, and since many of the machines in the field have the larger number of bins, it becomes necessary to be concerned about keeping the bins unloaded without down time when the machine is running.

It is particularly desirable to have great reliability in handling the envelopes as they are conveyed, approach, and are pushed into the stacking bins, against the supporting abutment member located on the stacking support of the stacker bin. If there are jams in this area of the machine, there is a great potential for damaging the envelopes, in addition to causing machine down time. Unfortunately, the present designs for envelope stackers have not provided the reliability required to address the jam problem, and in addition the design of the stackers remain complicated without eliminating the jam problems. For example, in one envelope stacking apparatus, an envelope abutment member rests upon a conveyor belt which is horizontally disposed beneath the upstanding envelopes. When the envelopes develop a pushing force at the input gate of the stacker, they push a sensing lever pivotally mounted at the input gate. Often, the sensing device causes the envelopes to travel or become skewed in a vertical plane with respect to the conveyor path, thereby causing a jam. A switch is then actuated which in turn energizes a motor connected to the conveyor belt to move the envelope abutment member a distance commensurate with the distance moved by the sensing lever and so forth. The problem with this system lies in the response time since there is a rapid accumulation of envelopes during the cycle time described, which leaves a potential for a jam by not allowing envelopes to move from the input gate during the time interval when the abutment member is stationary and then caused to move.

Another device applied to the envelope stacking apparatus to provide a uniform force to the envelope abutment member is a sash weight and pulley system. The sash weight is operatively connected to a cable which is supported on guide pulleys. When the envelopes enter the stacking bin, an accumulation of them provides a pushing force which subsequently pushes back the envelope abutment member. There is also some form of mechanical pushing device such as a brush at the input gate which keeps the envelopes moving towards the envelope abutment member. The problem with this system is that it is bulky, and particularly cumbersome and there is a potential that the cable will break, thereby permitting the envelope abutment member to slam and be damaged against its stop. This situation then presents a further potential for losing the use of the machine.

Therefore, it is intended that the present invention eliminate the foregoing mentioned problems with increased reliability, better response, versatility, and application of a uniform resisting force to the envelope stack to eliminate jams at the input side of the envelope stacker.

SUMMARY OF THE INVENTION

The problems defined above, are solved by the present invention wherein an envelope stacking machine has a conveyor for feeding envelopes along a path of travel leading to envelope stacking bins. Each envelope stacking bin has an elongate envelope stacking support for receiving the envelopes. The envelopes are pushed into the stacking bin against a uniform resistive force provided by a force converting device connected to an envelope abutment member.

More broadly, within an envelope stacking machine there is a conveyor for feeding substantially vertically oriented envelopes in succession along a predetermined path of travel. There is an elongate envelope stacking support disposed adjacent to the conveyor with its longitudinal axis positioned substantially perpendicular to the path of travel of the envelopes. A transfer device intercepts the envelopes moving along the path of travel and redirects them for movement along the elongate envelope stacking support. The envelopes are pushed by the successively fed envelopes against an envelope abutment member which moves along a parallel path with respect to the longitudinal axis of the elongate envelope stacking support as the envelopes accumulate. There is a resilient member interposed between the elongate envelope stacking support and the envelope abutment member for normally urging the envelope abutment member towards the transfer device. A force converting device is interconnected between the resilient member and the movable envelope abutment member for maintaining a uniform resisting force on the envelope abutment member in opposition to the pushing force exerted by the incoming envelopes. There is a resilient member interposed between the stacking support and the movable abutment member for normally urging the abutment member toward the transfer device, thereby maintaining a resisting force on the abutment member in opposition to the pushing force imposed thereon by the envelopes. A force converting device interconnected between the resilient member and the movable abutment member prevents the resisting force from increasing as the resilient member expands in response to movement of the abutment member away from the transfer device. Therefore, the abutment member exerts a uniform or gradually decreasing degree of resistance, during movement of the abutment member away from the transfer device to the transfer of envelopes from the conveyor apparatus to the stacking support to prevent envelopes from jamming at the transfer device.

The force converting device includes a first flexible member connected to a free end of the resilient member, and a second flexible member connected to the abutment device. And, a rotary displacement device interconnecting the flexible member to move a variable distance for a given amount of angular displacement of the rotary displacement device in response to movement of the second flexible member over a predetermined distance during the angular displacement of the rotary displacement device.

With the foregoing in mind, it is a primary object of the present invention to provide an envelope stacking apparatus having substantial reliability through reduction of potential jams at the input gate of the stacking bin.

It is another object of the present invention to provide an envelope stacking apparatus which has an envelope abutment member having a constant force acting upon accumulating envelopes in the envelope stacking bin in response to incrementally added envelopes at the input gate.

DESCRIPTION OF THE PREFERRED EMBODIMENT

Figure 1:
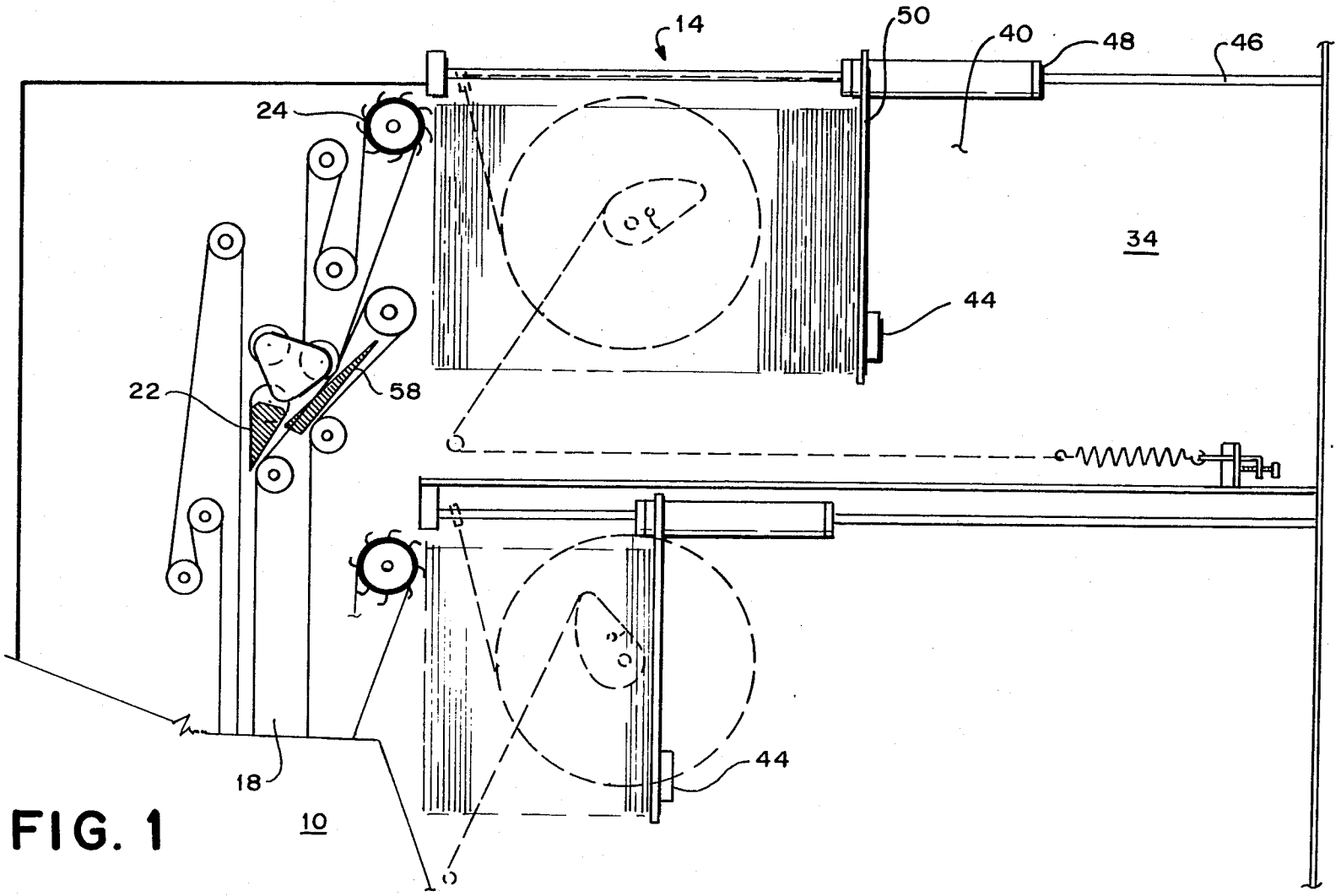
FIG. 1 represents a plan view of a portion of an envelope stacking machine having a conveyor for feeding vertically oriented envelopes in succession towards one of a number of envelope stacking bins.

Referring to FIG. 1 there is shown a portion of an envelope stacking machine 10, having a number of envelope stacking bins. There is an envelope stacking bin 14, which is representative of a number of similar stacking bins in the letter mail sorting equipment utilized in a U.S. Post Office. In fact, the envelope stacking machine 10 is basically representative of the Pitney Bowes Inc. OCT Bar Code mail sorter, currently in use in U.S. Post Offices all over the United States. The present invention is directed towards that machine, or similar machines as an improvement to handling letter mail beyond present capability and reliability of the Pitney Bowes Inc. Bar Code mail sorter.

Referring once again to FIG. 1, there is a conveyor path 18 for envelopes proceeding from an input station (not shown). The envelopes are oriented substantially vertically as they are transported along the conveyor path 18, and as they approach a gating area 22 which leads to a transfer device 24 for imparting a nudging action to the envelopes directed to the particular envelope stacking bin that the envelopes are being directed to.

The envelopes are stream fed, through the previously mentioned conveyor path 18, to the transfer device 24, from where they proceed to an elongate envelope stacking support 34 within which the instrumentalities of the present invention are operatively connected.

Figure 2:
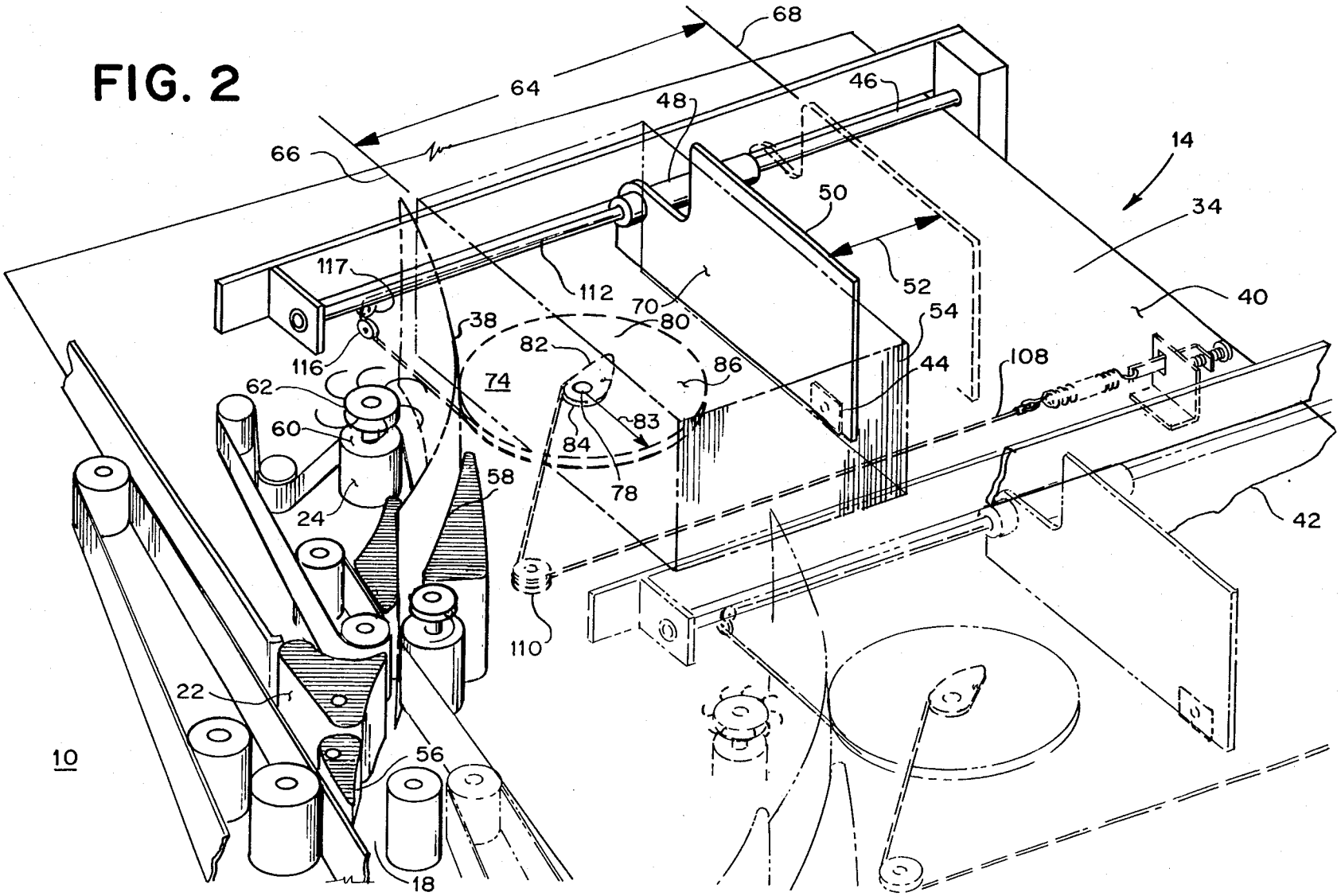
FIG. 2 represents a partial isometric view taken from FIG. 1 along the lines of movement of the envelope towards a stacking bin to illustrate instrumentalities within the stacking bin.

The elongate envelope stacking support 34 is arranged to receive a stream of envelopes such as an envelope 38 shown in FIG. 2. There is a supportive structure (not shown) beneath the elongate envelope stacking support 34 such that the entire envelope stacking machine 10 is appropriately capable of handling the envelopes on a generally horizontal plane 42 which is generally set to a convenient height for the operator. The horizontal plane 42 will be understood to be provided by appropriately arranged horizontal members which the envelopes bottom edges guide and rest upon during conveyance. In other words, a surface 40 of the elongate envelope stacking support 34 is within the horizontal plane 42 and substantially perpendicular to the conveyor path 18, in order to support the envelopes since the envelopes, such as the envelope 38, are oriented in a substantially vertical position while being conveyed through the conveyor path 18.

Now, referring to FIG. 2 where details of the stacker bin 14 are shown, there is an elongate shaft 46 supported at both ends (unshown) fixed structure connected to the envelope stacking machine 10. The elongate shaft 46 has a reciprocable bearing member 48 to which there is an envelope abutment member 50 appropriately attached. The abutment member 50 as such, has a plastic foot 44 attached to the member 50 to rest upon the surface 40 during sliding, reciprocable motion.

The envelope abutment member 50 moves in a parallel direction, indicated by an arrow 52 which direction is substantially along the lines of the longitudinal plane of the elongate envelope stacking support 34. Within FIG. 2, there is shown a stack of vertically standing envelopes 54 which is typical of the intent of the envelope stacking machine 10.

The envelopes fed through the conveyor path 18 are individually pushed onto the elongate envelope stacking support 34, and the process whereby the envelope abutment member 50 resists with a uniform or gradually decreasing input force directed against the transfer device 24 will now be explained. It is intended that any given envelope, such as the envelope 38 be deflected from the conveyor path 18, at such predetermined time that a gate 56 is operatively moved to deflect an envelope to the appropriate envelope stacker bin. It is seen in FIG. 2 that the envelope 38 has been deflected, from the conveyor path 18, and is traveling along a deflected path 58 towards the transfer device 24, and the stacker bin 14.

The transfer device 24 consists of a roller spindle 60 which is operatively driven by appropriate connecting timing belts (not shown) beneath the envelope stacking support 34. The other belts and conveying devices illustrated in the accompanying drawings are also operatively connected to appropriate motors, and reduction instrumentalities which are not shown in the drawings, but understood by those skilled in the art to provide the requirements of conveying letter envelopes at the rate of 128 inches per second.

In the present invention, there is a flexible finger assembly 62 mounted for rotation with the roller spindle 60.

The flexible finger assembly 62 constitutes the principle pushing element of the transfer device 24, which forces the individual envelopes into the stacking bin 14.

Figure 3:
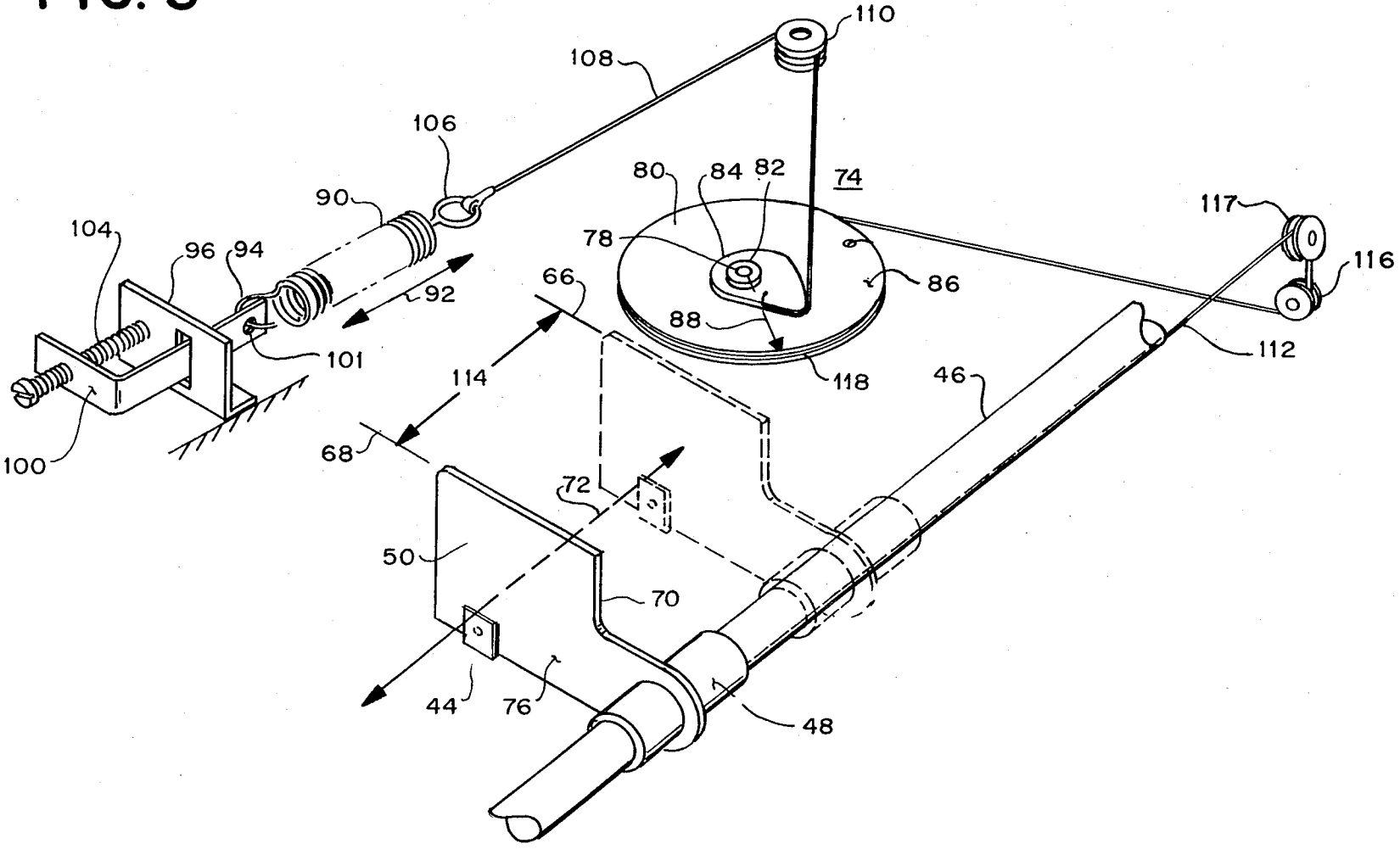
FIG. 3 illustrates a partial isometric view taken from FIG. 1, as viewed from the front side of the envelope stacking machine to show details of the force converting apparatus, of the present invention.

It will be seen in FIG. 2 that the envelope abutment member 50 is approximately one half of the distance across a span 64 which represents an opening for a capacity of 425 average sized envelopes at such time as the abutment member 50 reaches a maximum capacity position 68. The envelope abutment member 50 normally starts its path of travel through the span 64 at a position 66, where the initial envelopes immediately engage a face plate 70 of the envelope abutment member 50. The unstacked envelopes continue to be fed along the conveyor path 18, and be diverted to the alternate individual appropriate envelope stacking bins according to predetermined zip code designations. While diverted envelopes continue to flow into the elongate stacking support 34, the envelope abutment member 50 continues to provide a uniform resisting force against the nudging force of the transfer device 24 as represented by a force vector in the form of a dotted line and arrow 72 (FIG. 3). The uniform resisting force remains exactly at 1.5 pounds, for the present application, but will be applied in a different force level according to the particular job being done in other applications where, for example, substantially heavier envelopes are processed. At this time it will be mentioned that there is an alternate embodiment of the degree of application of the force to the envelope abutment member 50, as the member 50 is normally pushed away from the transfer device 24. The alternate application of force is gradually uniformly decreasing, instead of uniform. It will be readily understood that it is entirely possible to choose and adjust the particular force desired in other similar envelope sorting applications, and as mentioned, the first applied force being presently described is considered uniform.

The application of the uniform resisting force to the envelope abutment member 50 will be readily understood from the description of the force converting system to now be explained.

Beneath the elongate stacking support 34, there is a force converting apparatus 74 which is appropriately mounted for operation in response to incremental movement of the envelope abutment member 50 caused by individual envelopes such as the envelope 38 shown in FIG. 2 as they are pushed into the envelope stacking bin 14 by the transfer device 24.

Figure 4:
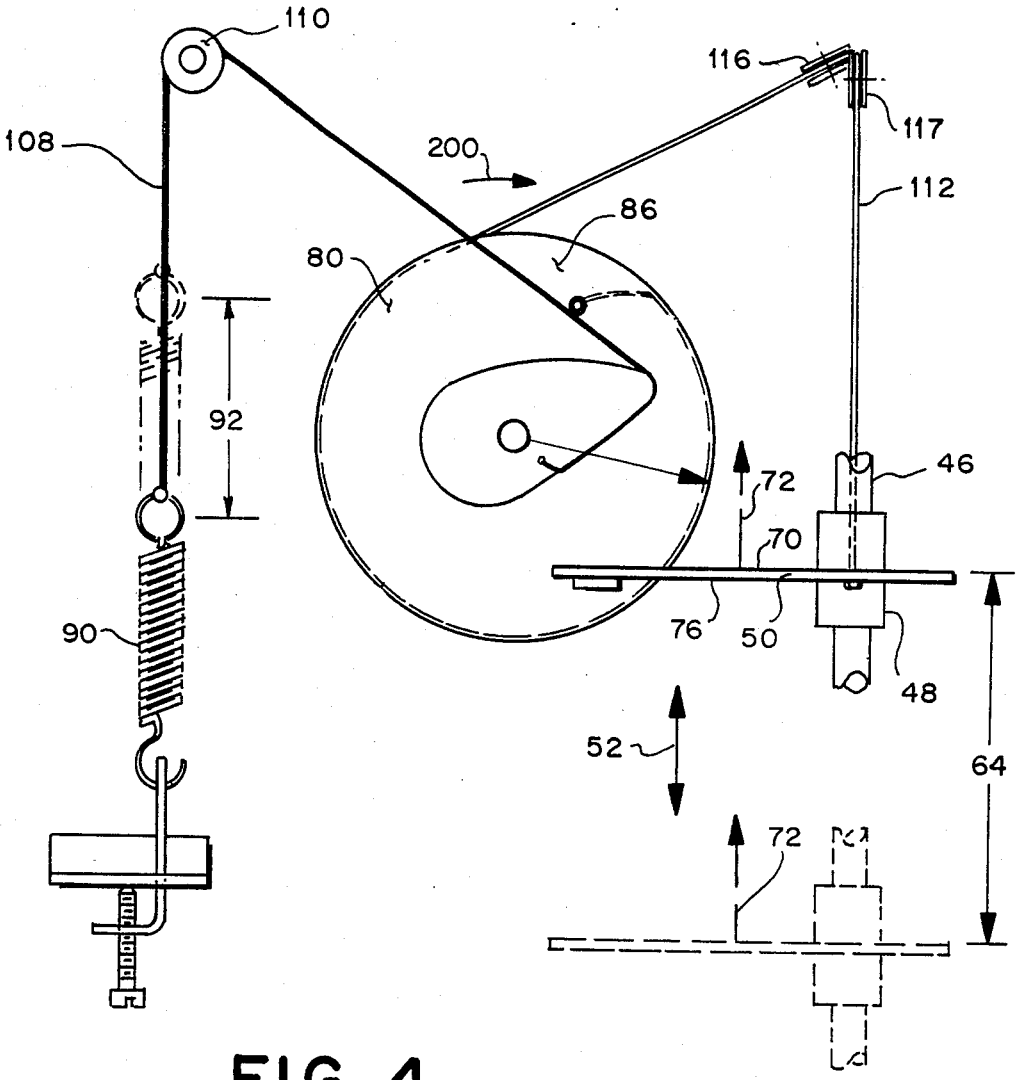
FIG. 4 is a top view of the force converting apparatus, as taken from FIG. 3.

Referring to FIG. 3, there is shown an isometric view of the principle instrumentalities of the force converting apparatus 74. It will be understood that the upper portions of the envelope stacking machine 10 have been removed including the elongate envelope stacking support 34 to provide the details illustrated in FIGS. 3 and 4, and furthermore that the force converting apparatus 74 is illustrated in an angular orientation that the envelope stacking machine 10 operator sees while standing in front of the machine, as opposed to the FIGS. 1 and 2 where the views are taken obliquely from the opposite side.

An opposite side 76 of the envelope abutment member 50 is facing the operator as represented in FIG. 3, and the envelope abutment member 50 is shown in the maximum capacity position 68 representative of a fully loaded stacker. The maximum capacity position 68 furthermore provides a clear view of portions of the force converting apparatus 74, which would be otherwise somewhat obstructed from view when the envelope abutment member 50 is in its starting position adjacent to the transfer device 24 and the roller spindle 60.

There is a rotary displacement device 80 mounted for rotation about an appropriate stud 78 which is suitably fastened to the underside of the elongate envelope stacking support 34. The rotary displacement device 80 is formed of a first pulley 82, which has a portion of its circumference having a varying radius 84 while a second pulley 86 has a large diameter with a uniform radius 88.

There is a resilient member 90 mounted for lineal expansion and contraction in a parallel direction 92 with respect to the elongate shaft 46 so that an end 94 is attached to a bracket assembly 96, having an adjustment member 100 for adjustment of the resilient member 90 when necessary. The resilient member 90 is preferably a wound tension spring, having ends formed from the coils. The end 94 is connected to a hole 101 in the adjustment member 100 and an appropriate screw 104 is threaded into the member 100 as such to accomplish the adjustment as required.

On a free end 106 of the resilient member 90, there is suitably attached a first flexible member 108 which spans from the free end 106 to a horizontally mounted, rotatable pulley 110. The rotatable pulley 110 is conveniently mounted under the elongate envelope stacking support 34. The first flexible member 108 is a suitable non-stretching form of cable which will easily bend when turned about a groove in a relatively small flanged pulley.

Reaching from the rotatable pulley 110 to the rotary displacement device 80, the first flexible member 108 is suspended upon the first pulley 82 having the varying radius 84. The first flexible member 108 is conveniently secured to the first pulley 82, and similarly the second flexible member 112 is secured to the second pulley 86. Given an angular displacement of the rotary displacement device 80 caused by a stream of envelopes being pushed into the stacker 14, the second flexible member 112 moves a predetermined distance, which is represented by a lineal distance 114 (FIG. 3), alongside of the envelope abutment member 50. And, since the second flexible member 112 is suspended in a groove 118 within the second pulley 86 having the uniform radius 88, it will cause a clockwise angular rotation 200 of the second pulley 86 and a corresponding angular rotation of the attached first pulley 82 as the second flexible member 112 unwinds from the second pulley 86. As the first flexible member 108 is wound on the first pulley 82, it stretches the tension spring 90 and thereby produces an increasing tension in the first flexible member 108. Since it is evident to those skilled in the art that the tension in the second flexible member 112 will be the tension in the first flexible member 108 multiplied by the varying radius 84 and divided by the constant radius 88, the varying radius 84 must decrease in length as the pulleys rotate and stretch the spring 90, if the tension in the second flexible member 112 is to be maintained constant with the movement of the abutment 50. Therefore the varying radius 86 decreases in an inverse proportion to the spring constant of spring 90. It is mentioned once again, that the system being described herein is intended to produce a uniform input force to the envelope abutment member 50, and as such, the description of the force converting apparatus 74 accomplish the required uniform force through the described geometry of the first pulley 82. It will therefore be recognized that various shapes and profiles to the varying radius 84 of the first pulley 82 will produce the alternate embodiment previously described where a uniformly decreasing input force is applied to the envelope abutment member 50.

Accordingly, the second flexible member 112 is spanned along a path leading to an appropriately mounted, grooved pulleys 116 and 117 which are used to change direction of the second flexible member 112 to a path substantially parallel to movement of the envelope abutment member 50, to which the member 112 as such is suitably attached.

It will be recognized that the span 64 (FIG. 2) which the envelope abutment member 50 moves through when receiving the stream of envelopes is a substantial distance in comparison to the deflection of the resilient member 90. And, the resilient member 90 is typical in respect to a wound coil spring which as the ability to produce a maximum force coincident with a maximum deflection, and a minimum force coincident with a minimum deflection beyond the free state. The degree of variation thereby given by the wound string would ordinarily produce a variation of force resulting in a gradually increasing degree of force upon the envelope abutment member 50 in the present case but for the force converting apparatus 82.

The desired result of the application of the force converting apparatus 82 is given at the envelope abutment member 50 where a uniform resisting force is maintained over the span 64 of movement caused by the stream of envelopes entering the envelope stacker bin 14, and being nudged towards the envelope abutment member 50. As the envelopes are pushed towards the envelope abutment member 50, by the transfer device 24, a reciprocal uniform resisting force is maintained through application of the previously described force converting apparatus 74.

Since there is no extended response time for the envelope abutment member 50 to move in accordance with envelopes being added to the envelope stacker bin 14, there is no potential for jams at the gating area 22 or the transfer device 24. Since the mass of the force converting apparatus 74 can be made less than a corresponding sash weight it will be recognized that the energy stored in the spring 90 will only be about sixty percent of that stored in a sash weight raised to a corresponding height position with respect to the movement of the abutment 50. Therefore the likelihood of breaking the second flexible member 112 is greatly reduced if not eliminated as compared to the sash weighted abutment described earlier.

Having described an embodiment of the present invention for an envelope stacking machine, it is pointed out that various modifications may be made to the parts described within the foregoing specification and drawings which will serve the same purpose outlined and captured by the accompanying following claims.

What is claimed is:

1. An envelope stacking machine comprising:

A. conveyor means for feeding a plurality of substantially vertically oriented envelopes in succession along a predetermined path of travel, B. an elongate envelope stacking support disposed adjacent said conveyor means with its longitudinal axis substantially perpendicular to said path of travel, C. transfer means for intercepting envelopes moving along said path of travel and for redirecting said envelopes for movement along said stacking support, D. envelope abutment means mounted on said stacking support for movement in a direction parallel to said longitudinal axis of said stacking support in response to a pushing force imposed on said abutment means by successive envelopes accumulating on said stacking support, E. resilient means interposed between said stacking support and said movable abutment means for normally urging said abutment means toward said transfer means, thereby maintaining a resisting force on said abutment member in opposition to said pushing force imposed thereon by said envelopes, and F. force converting means interconnected between said resilient means and said movable abutment means for preventing said resisting force from increasing as said resilient means expands in response to movement of said abutment means away from said transfer means, whereby said abutment means exerts a uniform or gradually decreasing degree of resistance, during movement of said abutment means away from said transfer means, to the transfer of envelopes from said conveyor means to said stacking support to prevent envelopes from jamming at said transfer means.

2. A machine as set forth in claim 1 wherein said resilient means comprises a spring having one end connected to said stacking support and which provides a varying output force depending upon the degree of deflection of said spring, said force converting means converting said varying output force over the degree of spring deflection to a non-increasing input force on said abutment means over the extent of movement of said abutment means along said stacking support.

3. A machine as set forth in claim 2 wherein said force converting means comprises:

A. a first flexible member connected to said free end of said spring,

B. a second flexible member connected to said abutment means, and

C. rotary displacement means interconnecting said flexible members for causing said first flexible member to move a variable distance for a given amount of angular displacement of said rotary displacement means in response to movement of said second flexible member over a predetermined distance during said angular displacement of said rotary displacement means.

4. A machine as set forth in claim 3 wherein said rotary displacement means comprises:

A. a first pulley connected to said first flexible member and having a varying radius so that rotation of said first pulley through said given angular displacement causes said first flexible member to move through said variable distance, and B. a second pulley mounted coaxially with and fixed to said first pulley for rotation therewith, said second pulley being connected to said second flexible member and having a uniform radius so that rotation of said second pulley through said angular displacement causes said second flexible member to move through said predetermined distance.

5. A machine as set forth in claim 4 wherein the radius of said first pulley varies in accordance with the degree of variation of the force exerted by said resilient means during deflection thereof.

6. A machine as set forth in claim 5 wherein said variation of the radius of said first pulley is selected so as to cause said resilient means to maintain a uniform resisting force on said abutment member in opposition to the pushing force imposed on said abutment member as successive envelopes accumulate on said stacking support.

7. A machine as set forth in claim 5 wherein said variation of the radius of said first pulley is selected so as to cause said resilient means to exert a gradually decreasing resisting force on said abutment member in opposition to the pushing force imposed on said abutment member as successive envelopes accumulate on said stacking support.

8. A machine as set forth in claim 5 wherein the radius of said second pulley is larger than the radius of said first pulley so that said abutment means moves a greater distance during said given angular displacement of said rotary displacement means than said variable distance of said first flexible means.

* * * * *